US007765731B1

(12) United States Patent
Liebig

(10) Patent No.: US 7,765,731 B1
(45) Date of Patent: Aug. 3, 2010

(54) QUICK RELEASE GUN SIGHT ADAPTER

(75) Inventor: Michael T Liebig, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/392,895

(22) Filed: Mar. 30, 2006

(51) Int. Cl.
*F41G 1/38* (2006.01)

(52) U.S. Cl. ..... 42/127; 42/124; 42/148; 42/113

(58) Field of Classification Search ..... 42/127, 42/124, 128, 148, 147, 111, 113
See application file for complete search history.

(56) References Cited

U.S. PATENT DOCUMENTS

| | | | | | |
|---|---|---|---|---|---|
| 2,545,419 | A | * | 3/1951 | Williams | 42/127 |
| 4,021,954 | A | | 5/1977 | Crawford | |
| 4,249,315 | A | * | 2/1981 | Hopson, III | 42/125 |
| 4,571,870 | A | * | 2/1986 | Heideman et al. | 42/1.01 |
| 4,776,126 | A | | 10/1988 | Williams | |
| 4,806,007 | A | | 2/1989 | Bindon | |
| 4,841,659 | A | * | 6/1989 | Williams | 42/124 |
| 5,033,219 | A | * | 7/1991 | Johnson et al. | 42/115 |
| 5,222,302 | A | | 6/1993 | DeBatty et al. | |
| 5,272,514 | A | * | 12/1993 | Dor | 356/251 |
| 5,396,725 | A | * | 3/1995 | Talbot | 42/127 |
| 5,425,191 | A | | 6/1995 | Taylor et al. | |
| 5,887,375 | A | * | 3/1999 | Watson | 42/106 |
| 5,901,452 | A | | 5/1999 | Clarkson | |
| 6,327,806 | B1 | * | 12/2001 | Paige | 42/113 |
| 6,336,285 | B1 | * | 1/2002 | Baumer | 42/124 |
| 6,594,938 | B2 | * | 7/2003 | Horton | 42/127 |
| 6,606,813 | B1 | * | 8/2003 | Squire et al. | 42/90 |
| 6,619,179 | B2 | | 9/2003 | Mika | |
| 6,662,486 | B2 | | 12/2003 | Komberger | |
| 6,701,660 | B2 | | 3/2004 | Stover | |
| 6,708,439 | B1 | | 3/2004 | Laitala | |
| 6,779,290 | B1 | * | 8/2004 | Houtsma | 42/148 |
| 6,886,287 | B1 | * | 5/2005 | Bell et al. | 42/120 |
| 6,931,778 | B1 | * | 8/2005 | Nelson et al. | 42/120 |
| 7,069,685 | B2 | * | 7/2006 | Houde-Walter | 42/132 |
| 7,234,265 | B1 | * | 6/2007 | Cheng et al. | 42/113 |
| 7,296,376 | B2 | * | 11/2007 | Kidd | 42/136 |
| 2005/0039369 | A1 | * | 2/2005 | Wilson | 42/124 |
| 2006/0117636 | A1 | * | 6/2006 | Newhall et al. | 42/124 |
| 2006/0162227 | A1 | * | 7/2006 | Samson | 42/148 |

* cited by examiner

*Primary Examiner*—Michelle Clement
(74) *Attorney, Agent, or Firm*—John Gladstone Mills; Mark O. Glut; U.S. Navy-NAVAIR-Nava: Systems Command

(57) ABSTRACT

The quick release gun sight adapter includes a scope adapter, a red dot sight adapter, a locking block, a spring loaded ramped blade, and a spring loaded latch piston. The red dot sight adapter is attachable to a red dot sight and the ramped blade is attached to the red dot sight adapter. The ramped blade is rotatably attachable to the scope adapter, and the scope adapter is rotatably adapted to hold the ramped blade such that when the ramped blade is attached to the scope adapter, and the ramped blade and the red dot sight adapter are rotated the ramped blade engages the locking block and locks the ramped blade into place. The piston communicates with the locking block such that when actuated the piston engages the locking block such that the ramped blade and red dot sight adapter may be rotated and unattached from the scope adapter.

11 Claims, 4 Drawing Sheets

QUICK RELEASE GUN SIGHT ADAPTER

STATEMENT OF GOVERNMENT INTEREST

The invention described herein may be manufactured and used by or for the Government of the United States of America for governmental purposes without payment of any royalties thereon or therefor.

BACKGROUND

The present invention relates to a quick release gun sight adapter. More specifically, but without limitation, the present invention relates to a quick release red dot gun sight adapter.

Currently, typical military weapons, such as guns, utilize a fixed iron sight or a fixed red dot sight. Only one sight is attached to the weapon at a time. Often the red dot sight is unusable due to weather conditions (such as precipitation); therefore, another type of sight, such as the iron sight, needs to be used. Each sight needs to be individually changed and adjusted. Changing sights is difficult and time consuming. Each time a sight is changed the weapon requires sighting in and the sights need to be adjusted. This wastes valuable time, especially in military or force protection situations.

Thus, there is a need in the art to provide a quick release gun sight adapter that allows both an iron sight and a red dot sight to be concurrently attached to a weapon and a quick release gun sight adapter without the limitations inherent in present methods.

SUMMARY

The present invention is directed to a quick release gun sight adapter. The quick release gun sight adapter includes a scope adapter, a red dot sight adapter, a locking block, a spring loaded ramped blade, and a spring loaded latch piston. The scope adapter is attachable to a scope and the scope is attachable to a gun. The red dot sight adapter is attachable to a red dot sight and the ramped blade is attached to the red dot sight adapter. The ramped blade is rotatably attachable to the scope adapter, and the scope adapter is rotatably adapted to hold the ramped blade such that when the ramped blade is attached to the scope adapter, and when the ramped blade and the red dot sight adapter are rotated, the ramped blade engages the locking block. When the ramped blade is further rotated the locking blade locks the ramped blade into place. The piston communicates with the locking block such that when actuated the piston engages the locking block such that the ramped blade and the red dot sight adapter may be rotated and unattached from the scope adapter.

It is a feature of the invention to provide a quick release gun sight adapter that allows two sight systems to be concurrently attached to a scope.

It is a feature of the invention to provide a quick release gun sight adapter that enables quick removal for in-climate conditions to attain use of the back up iron sight.

BRIEF DESCRIPTION OF THE DRAWINGS

These and other features, aspects and advantages of the present invention will become better understood with reference to the following description and appended claims, and accompanying drawings wherein:

DETAILED DESCRIPTION

Figure 1:
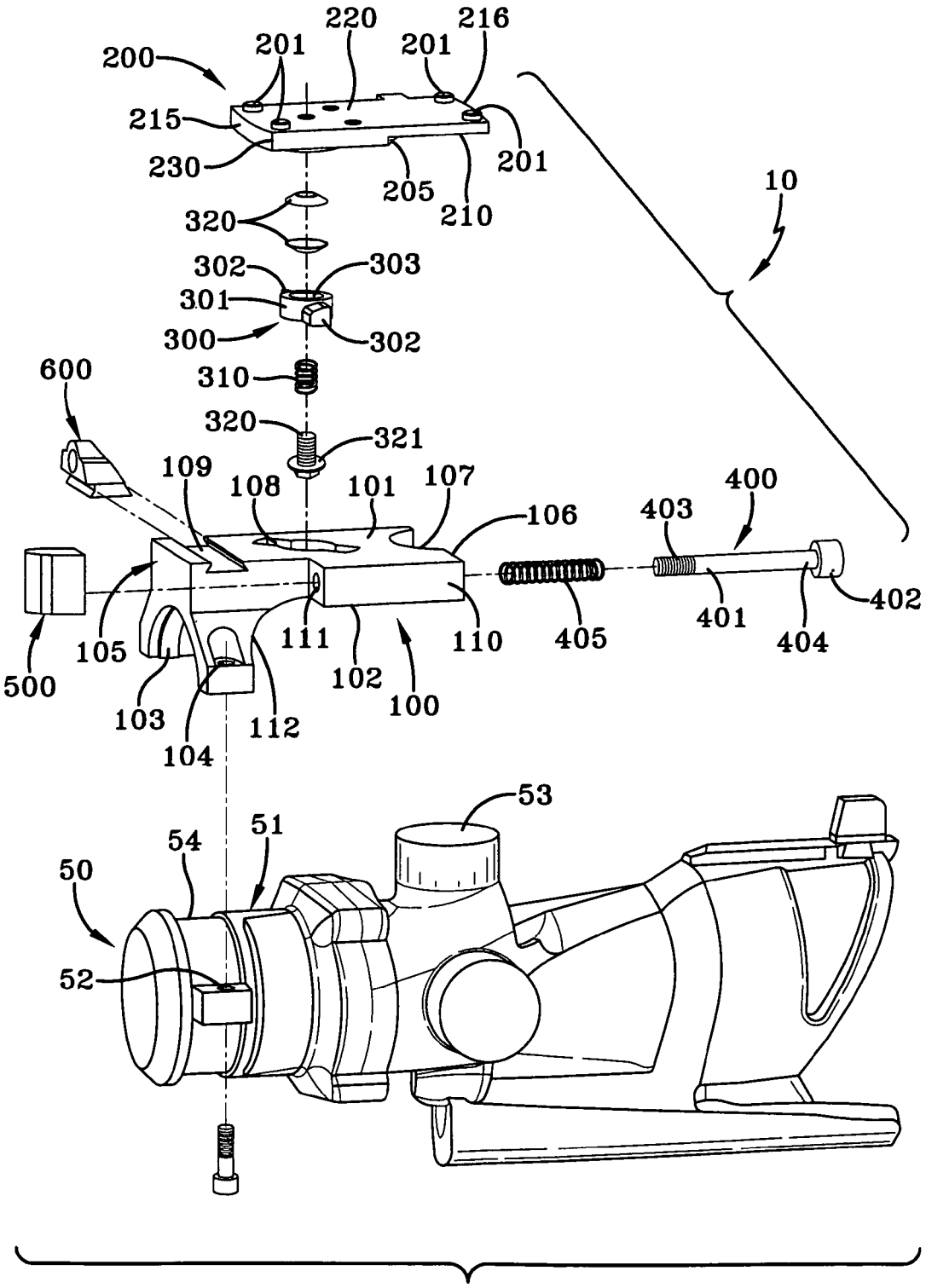
FIG. 1 is an exploded perspective view of an embodiment of the quick release gun sight adapter and a gun scope.

The preferred embodiments of the present invention are illustrated by way of example below and in the above listed figures. As seen in FIG. 1, a quick release gun sight adapter 10 includes a scope adapter 100, a red dot sight adapter 200, a spring loaded ramped blade 300, a spring loaded latch piston 400, and a locking block 500. The scope adapter 100 is attachable to a scope 50, while the scope 50 is attachable to a gun, particularly a machine gun (not shown). The red dot sight adapter 200 is attachable to a red dot sight (not shown). The spring loaded ramped blade or ramped blade 300 is attached to the red dot sight adapter 200. The ramped blade 300 is rotatably attachable to the scope adapter 100. The piston 400 communicates with the locking block 500 such that a latch is created. The scope adapter 100 is rotatably adapted to hold the ramped blade 300 such that when the ramped blade 300 is disposed within the scope adapter 100 and when the ramped blade 300 and the red dot sight adapter 200 are rotated the ramped blade 300 engages the locking block 500 to open the latch, and when the ramped blade 300 is further rotated the locking blade 500 is engaged to close the latch and lock the ramped blade 300 and the red dot sight adapter 200 into place. When actuated, the piston 400 opens the latch such that the ramped blade 300 and red dot sight adapter 200 may be rotated and unattached from the scope adapter 100.

In the discussion of the present invention, the invention will be discussed in a M4 carbine environment; however, this invention can be utilized for any type of need that requires use of a quick release gun sight adapter or quick release adapter.

Figure 2C:
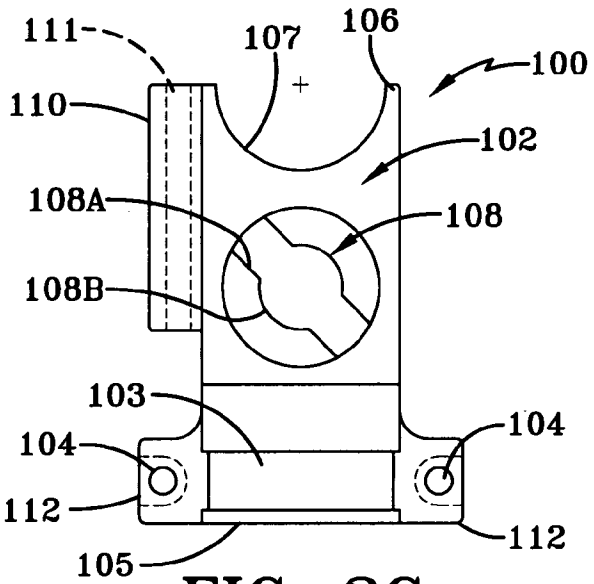
FIG. 2C is a bottom view of an embodiment of the scope adapter.
Figure 2E:
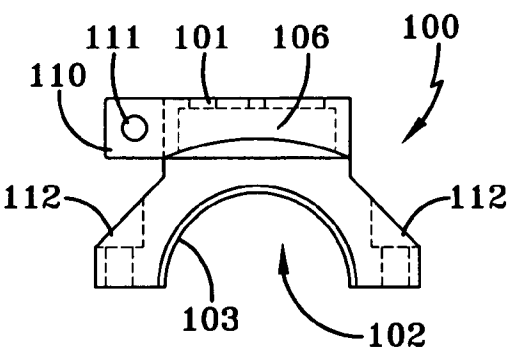
FIG. 2E is a front view of an embodiment of the scope adapter.

As seen in FIG. 1, the scope adapter 100 is attachable to a scope 50, particularly, but without limitation, to an ACOG scope. The scope adapter 100 is configured to attach to the scope 50 and act as a platform. As seen in FIGS. 1, 2A, 2B, 2C, 2D and 2E, the scope adapter 100 may include an upper scope adapter portion 101, a lower scope adapter portion 102, a first scope adapter end portion 105 and a second scope adapter end portion 106. The lower scope adapter portion 102 is configured to correspond to a portion of the scope 50, particularly a top portion 51 of the scope 50. The scope adapter 100, particularly the lower scope adapter portion 102, may include a circular portion 103 that corresponds to the top of the viewing portion or lens 54 of a scope 50. The circular portion 103 may be at the first scope adapter end portion 105. As seen in FIG. 1, the circular portion 103 may envelop a top portion of the lens 54 (which typically has a circular cross section). The circular portion 103 may also include locking apertures 104 that correspond to scope apertures 52 (the scope apertures 52 disposed on the scope 50). The scope adapter 100 may be attached to the scope 50 via any type of fastener, such as, but without limitation, a screw or bolt that utilizes the locking apertures 104 and the scope apertures 52. As seen in FIGS. 1, 2B and 2C the locking apertures 104 may be disposed on scope adapter flanges 112. The scope adapter flanges 112 may be disposed on opposite diametrical sides of the circular portion 103 of the scope adapter 100. In an embodiment of the invention, there are two sets of corresponding locking apertures 104 and scope apertures 52. The scope adapter 100 may also include a semicircular cutout 107 located at the second scope adapter end portion 106. In the preferred embodiment of the invention, the semicircular cutout 107 and the circular portion 103 are spaced at about ninety degrees from each other. As seen in FIG. 1, the semicircular cutout 107 may correspond to an elevation adjusting knob 53 located on the top portion 51 of the scope 50.

The scope adapter 100 may also include a ramped blade aperture 108. As shown in FIG. 2B, the shape of the ramped blade aperture 108 corresponds to the ramped blade 300, and may be a rectangle 108A with a circle 108B disposed at about middle of the rectangle 108A. The rectangle 108A is angled to the sides of scope adapter 100. The preferred angle is about forty-five degrees. In the preferred embodiment, the diameter of the circle 108B is larger than the width of the rectangle 108A. The ramped blade aperture 108 extends through the scope adapter 100. In the preferred embodiment there is a counter bore or a circular fossa 114 that corresponds to the ramped blade aperture 108. The circular fossa 114 is located at the lower scope adapter portion 102. The circular fossa 114 does not extend entirely through the scope adapter 100 and the diameter of the circular fossa 114 may correspond to the length of the rectangle 108A of the ramped blade aperture 108. The ramped blade aperture 108 corresponds to the ramped blade 300 such that when the ramped blade 300 is placed within the ramped blade aperture 108 and the red dot sight adapter 200 (as well as the ramped blade 300) is rotated, the ramped blade 300 rotates within the circular fossa 114, the red sight adapter 200 engages the locking block 500 to open the latch and when the ramped blade 300 is further rotated the locking blade 500 is engaged to close the latch and lock the ramped blade 300 and the red dot sight adapter 200 into place.

Figure 2D:
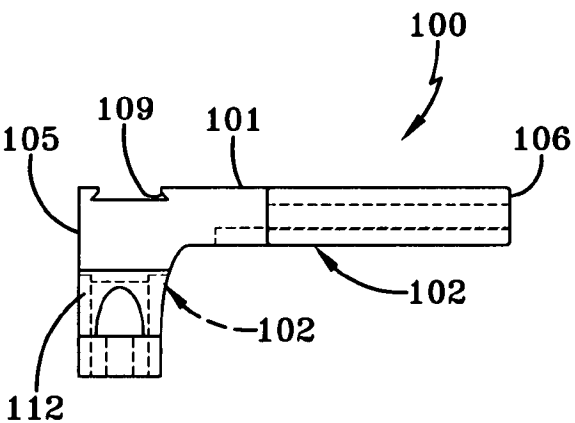
FIG. 2D is a side view of an embodiment of the scope adapter.
Figure 2B:
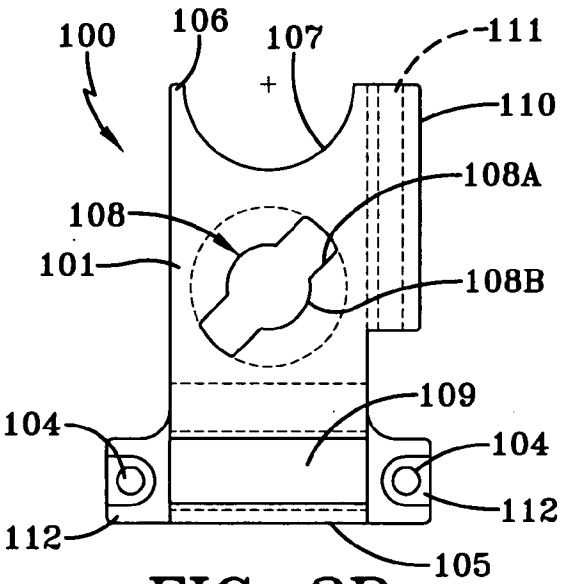
FIG. 2B is a top view of an embodiment of the scope adapter.
Figure 2A:
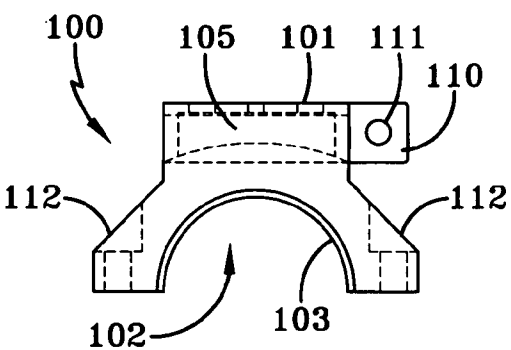
FIG. 2A is a rear view of an embodiment of the scope adapter.

As seen in FIGS. 1, 2B and 2D, the scope adapter 100 may also include a back up iron sight groove 109. The back up iron sight groove 109 may correspond to a back up iron sight 600 that may be utilized if the red dot sight is not being used or is unusable due to precipitation. The back up iron sight groove 109 may be configured such that a back up iron sight 600 may slide in and out of the back up iron sight groove 109. The back up iron sight 600 may be a standard off the shelf rear sight, or any type of iron sight practicable, and may be customized to shooter preference or mission requirements.

The scope adapter 100 may also include a latch piston portion 110. As seen in FIGS. 1, 2A, 2B, 2C and 2E, the latch piston portion 110 may be adjacent to the ramped blade aperture 108 and protrude latitudinaly or radially from the axis of the scope adapter 100. The latch piston portion 110 may include a latch piston chamber 111 that accepts the latch piston 400. The latch piston chamber 111 may be a hollow cylinder and may extend through the entire latch piston portion 110. In the preferred embodiment, the latch piston portion 110 extends from the second scope adapter end portion 106 toward the first scope adapter end portion 105, however, the latch piston portion 110 may terminate near the longitudinal or axial midpoint of the scope adapter 100 or at least terminate prior to extending to the first scope adapter end portion 105.

As shown in FIGS. 1, 3A, 3B, 3C, and 3D the red dot sight adapter 200 may be flat base that corresponds to the bottom of a red dot sight. The red dot sight adapter 200 may be substantially rectangular. The red dot sight adapter 200 may include a first red dot sight adapter end 215, a second red dot sight adapter end 216 and red dot sight tabs 201 to snap in and/or secure the red dot sight. The red dot sight adapter 200 may also include an extension tab 202, a bottom portion 210 and a top portion 220. The extension tab 202 may be disposed near or at the second red dot sight adapter end 216 and on the opposite side of where the red dot sight adapter 200 engages the locking block 500. The extension tab 202 may extend past the red dot sight adapter 200 and below the bottom portion 210 such that the extension tab 202 engages and has contact with the side of the scope adapter 100, particularly when the quick release gun sight adapter 10 is in the locked position (or when the latch closed).

The red dot sight adapter 200 may also include a fastener aperture 203 as well as two additional apertures 204. The fastener aperture 203 and the two additional apertures 204 extend through the entire red dot sight adapter 200 from the top portion 220 through the bottom portion 210.

Figure 3C:
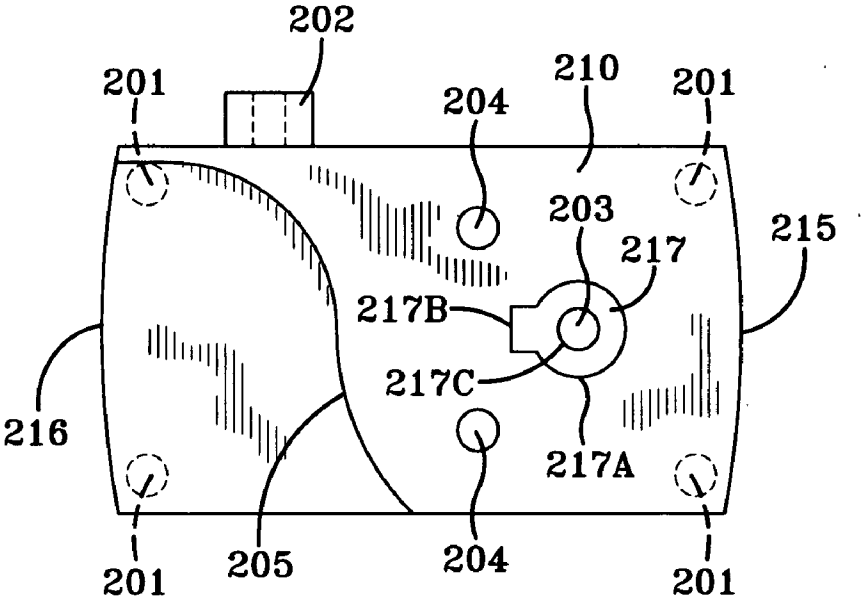
FIG. 3C is a bottom view of an embodiment of the red dot sight adapter.
Figure 3D:
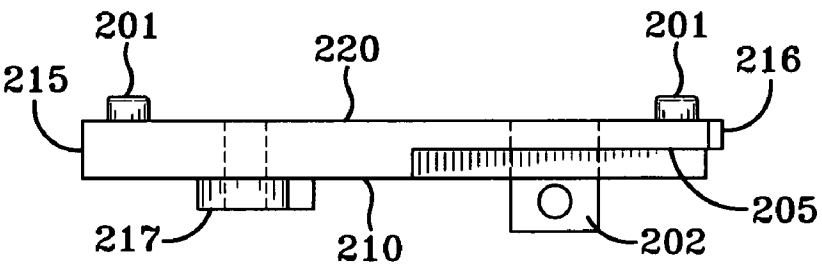
FIG. 3D is the opposite side view of an embodiment of the red dot sight adapter.
Figure 3B:
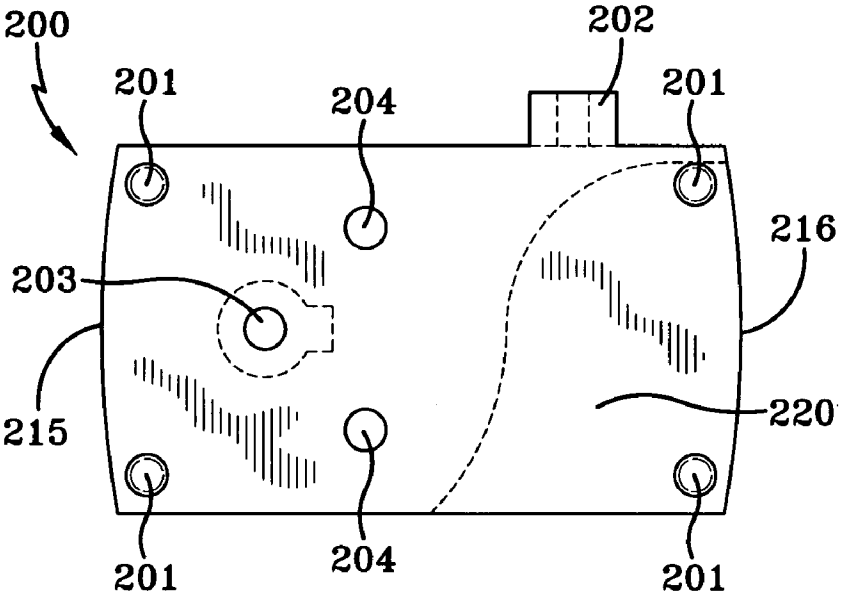
FIG. 3B is a top view of an embodiment of the red dot sight adapter.
Figure 3A:
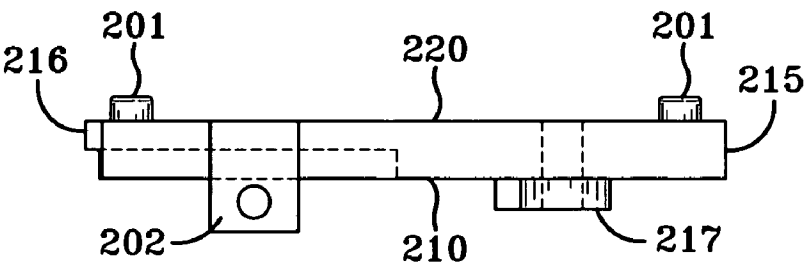
FIG. 3A is a side view of an embodiment of the red dot sight adapter.

In the preferred embodiment as shown in FIGS. 1, 3C and 3D, the red dot sight adapter 200 may have a cut-out relief, fossa or lip 205 at the bottom portion 210 of the red dot sight adapter 200. The lip 205 may start at the second red dot sight adapter end 216 and extend toward the first red dot sight adapter end 215. The lip 205 may be serpentine in shape and extend latitudinally on the red dot sight adapter 200. In the preferred embodiment of the invention, the lip 205 corresponds to the semicircular cutout 107 of the scope adapter 100, when the red dot sight adapter 200 or latch is in the closed or locked position.

The red dot sight adapter 200 may also include an aperture extension 217. The aperture extension 217 may be cylindrical and protrude from the bottom portion 210 of the scope adapter 200. The aperture extension 217 corresponds to the fastener aperture 203. As seen in FIG. 3C, in the preferred embodiment, the aperture extension 217 may include a cylindrical portion 217A, a projection portion 217B and an aperture extension bore 217C. The projection portion 217B may be rectangular and extend out from the cylindrical portion 217A toward the second red dot sight adapter end 216. The aperture extension bore 217C passes through the entire axial length of the cylindrical portion 217A and corresponds and is axially aligned to the fastener aperture 203.

Figure 4C:
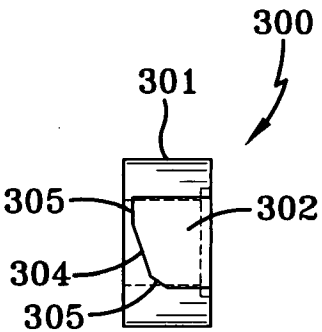
FIGS. 4B and 4C are opposite side views of an embodiment of the ramped blade.
Figure 4E:
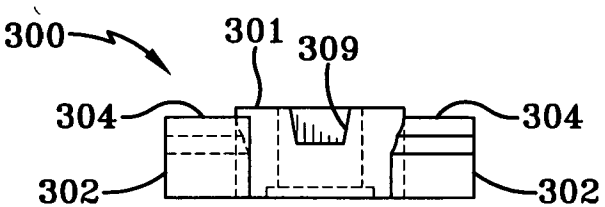
FIG. 4E is a front view of an embodiment of the ramped blade.
Figure 4A:
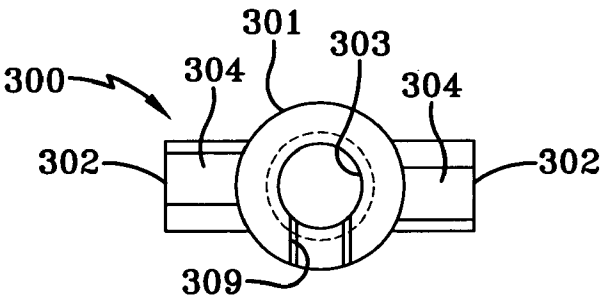
FIG. 4A is a top view of an embodiment of the ramped blade.
Figure 4D:
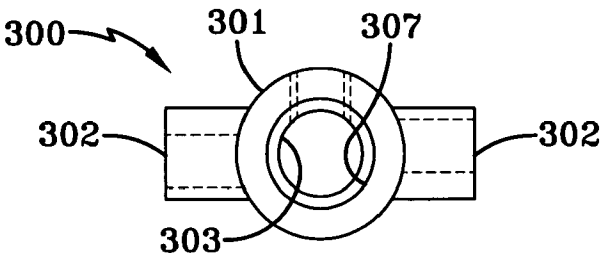
FIG. 4D is a bottom view of an embodiment of the ramped blade.
Figure 4B:
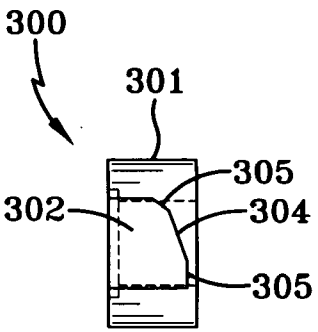

As shown in FIGS. 1, 4A, 4B, 4C, 4D and 4E, the ramped blade 300 may have a circular portion 301 and two side ramped portions 302. The circular portion 301 may be disposed between the two side ramped portions 302. The circular portion 301 may be substantially circular and include a ramped blade bore 303 for accepting a fastener 320 and a fastener spring 310 to fasten the ramped blade 300 to the red dot sight adapter 200. The ramped blade 300 may also utilize spring washers 320. The side ramped portions 302 may be disposed on opposite ends of a diameter line cut through the circular portion 301. The two side ramped portions 302 are disposed at about a ninety degree angle with the length of the red dot sight adapter 200. Each side ramped portion 302 may include a truncated portion 304 and the two side ramped portions 302 may be truncated in opposite directions. In the preferred embodiment, the side ramped portions 302 may include bevels 305. The circular portion 301 may also include a ramped blade counter bore 307 for accepting the head 321 of the fastener 320. The ramped blade counter bore 307 and ramped blade bore 303 may be axially aligned. As shown in FIGS. 4A, 4D and 4E, the circular portion 301 may also include a depression 309 or cut out which only extends through a portion of the circular portion 301 and does not extend in the axial direction through the circular portion 301. In the preferred embodiment, the diameter of the circular fossa 114 corresponds to the length of the ramped blade 300.

As shown in FIG. 1, the latch piston 400 may include a cylindrical portion 401 and a handle portion 402. The cylindrical portion 401 and the handle portion 402 may be axially aligned. The cylindrical portion 401 may include a first end 403 and a second end 404. The first end 403 or a portion of the first end 403 may be threaded to correspond to a bore in the locking block 500. At the second end 404, the handle portion 402 may be attached to the cylindrical portion 401. In the preferred embodiment, the latch piston 400 includes a spring 405. The spring 405 envelops the cylindrical portion 401. The cylindrical portion 401 is disposed within the latch piston chamber 111, with the first end 403 and the handle portion 402 disposed on opposite axial ends of the latch piston chamber 111. In the preferred embodiment, the handle portion 402 is at or near the second scope adapter end portion 106. The first end 403 may be threadedly attached to the locking block 500 such that the locking block 500 and handle portion 402 are on opposite axial ends of the latch piston portion 111.

In operation, the scope adapter 100 is attached to a scope 50 and is disposed on the scope 50 such that the first scope adapter end portion 105 is facing in the direction of the user of the gun and the second scope adapter end portion 106 is facing in the direction of the barrel of the gun. The lower scope adapter portion 102 is abutting the top portion 51 of the scope 50. The ramped blade 300 is placed in the ramped blade aperture 108. Upon placement of the ramped blade 300 in the ramped blade aperture 108, the red sight adapter 200 is at an angle to the scope adapter 100 (the sides of the red dot sight adapter 200 and scope adapter 100 are angled and are not aligned nor somewhat parallel). When the red dot adapter 200 is rotated, one of its corners 230 engages the locking block 500 and the ramped blade 300 slides within the circular fossa 114. As the red dot adapter 200 is rotated, the spring 405 in the spring loaded latch piston 400 is stretched and the locking block 500 is pushed back and away from the latch piston portion 110. As the red dot adapter 200 is further rotated, the corner 230 of the red dot sight adapter 200 passes past the locking lock 500. In the alternative, to create the same effect the handle portion 402 may be pushed and the locking block 500 moves away from the latch piston portion 110 to allow rotation of the red dot sight adapter 200. After the corner 230 passes by the locking block 500, the spring 405 of the spring loaded latch piston 400 contracts and the locking block 500 is pulled to abut the latch piston portion 110. The red dot adapter 200 is locked into place by the locking block 500 and the extension tab 202. When the quick release gun sight adapter 10 is in the locked position, the locking block 500 and the extension tab 200 are disposed on opposite sides of the red dot sight adapter 200. To unlock the red dot adapter 200, depress the handle portion 402 of the spring loaded latch piston 400, which pushes the locking block 500 past the red sot sight adapter 200, allowing the red dot sight adapter 200 to be rotated such the ramped blade 300 and ramped blade aperture 108 are lined up so that the red dot sight adapter 200 may be removed.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. A quick release gun sight adapter, comprising:

a scope adapter, the scope adapter attachable to a scope, the scope attachable to a gun;

a red dot sight adapter, the red dot sight adapter attachable to a red dot sight;

a locking block;

a spring loaded latch piston, the piston communicating with the locking block such that a latch is created, the latch communicating with the scope adapter; and a spring loaded ramped blade, the ramped blade attached to the red dot sight adapter, the ramped blade rotatably attachable to the scope adapter, the scope adapter rotatably adapted to hold the ramped blade such that when the ramped blade is disposed within the scope adapter and the ramped blade and the red dot sight adapter are rotated the ramped blade engages the locking block to open the latch and when the ramped blade is further rotated the locking blade is engaged to close the latch and lock the ramped blade into place, when actuated the piston opens the latch such that the ramped blade and the red dot sight adapter may be rotated and unattached from the scope adapter.

2. A quick release gun sight adapter, comprising:

a scope adapter, the scope adapter attachable to a scope, the scope attachable to a gun;

a red dot sight adapter, the red dot sight adapter attachable to a red dot sight;

a locking block;

a spring loaded ramped blade, the ramped blade attached to the red dot sight adapter, the ramped blade rotatably attachable to the scope adapter, the scope adapter rotatably adapted to hold the ramped blade such that when the ramped blade and the red dot sight adapter are rotated the ramped blade engages the locking block and when the ramped blade is further rotated the locking blade locks the ramped blade into place; and, a spring loaded latch piston, the piston communicating with the locking block such that when actuated the piston engages the locking block such that the ramped blade and the red dot sight adapter may be rotated and unattached from the scope adapter.

3. The quick release gun sight adapter of claim 2, wherein the scope adapter has a lower scope adapter portion, the lower scope adapter portion is configured to correspond to a top portion of the scope.

4. The quick release gun sight adapter of claim 3, wherein the scope adapter includes a circular portion, the circular portion corresponding to a top portion of a lens of the scope.

5. The quick release gun sight adapter of claim 4, wherein the scope adapter includes a semicircular cutout, the semicircular cutout corresponding to an elevation adjusting knob of the scope.

6. The quick release gun sight adapter of claim 5, wherein the scope adapter includes locking apertures for fasteners to attach the scope adapter to the scope.

7. The quick release gun sight adapter of claim 6, wherein the semicircular cutout and the circular portion are spaced at about ninety degrees from each other.

8. The quick release gun sight adapter of claim 7, wherein the scope adapter includes a ramped blade aperture, the ramped blade aperture corresponding to the spring loaded ramped blade.

9. The quick release gun sight adapter of claim 8, wherein the ramped blade aperture and the spring loaded ramped blade are in the shape of a rectangle with a circle disposed at about the middle of the rectangle.

10. A quick release gun sight adapter, comprising:

a scope adapter, the scope adapter attachable to a scope, the scope attachable to a gun, the scope adapter has a lower scope adapter portion, a circular portion, a semicircular cutout, locking apertures, a back up iron sight groove and a ramped blade aperture, the circular portion corresponding to a top portion of a lens of the scope, the semicircular cutout corresponding to an elevation adjusting knob of the scope, the semicircular cutout and the circular portion are spaced at about ninety degrees from each other, the locking apertures corresponding to fasteners that attach the scope adapter to the scope, the backup iron sight groove corresponding to a back up iron sight;

a red dot sight adapter, the red dot sight adapter attachable to a red dot sight, the red dot sight adapter including an extension tab;

a locking block;

a spring loaded ramped blade, the ramped blade aperture corresponding to the ramped blade, the ramped blade attached to the red dot sight adapter, the ramped blade rotatably attachable to the scope adapter via the ramped blade adapter, the scope adapter rotatably adapted to hold the ramped blade such that when the ramped blade is disposed within the ramped blade aperture and the ramped blade and the red dot sight adapter are rotated the red dot sight adapter engages the locking block and when the ramped blade is further rotated the locking blade and the extension tab lock the ramped blade and the red dot sight adapter into place; and, a spring loaded latch piston, the piston communicating with the locking block such that when actuated the piston engages the locking block such that the ramped blade and the red dot sight adapter may be rotated and detached from the scope adapter.

11. The quick release gun sight adapter of claim 10, wherein the scope adapter includes a circular fossa, the circular fossa having a diameter corresponding to the ramped blade and the ramped blade aperture, the ramped blade rotatable within the circular fossa.

* * * * *